United States Patent [19]

Koiso et al.

[11] Patent Number: 4,799,970

[45] Date of Patent: Jan. 24, 1989

[54] SURFACE TREATMENT METHOD FOR IMPROVING CORROSION RESISTANCE OF FERROUS SINTERED PARTS

[75] Inventors: Takashi Koiso; Satoshi Fujii, both of Itami, Japan

[73] Assignee: Sumitomo Electric Industries, Ltd., Osaka, Japan

[21] Appl. No.: 75,199

[22] Filed: Jul. 16, 1987

Related U.S. Application Data

[63] Continuation of Ser. No. 857,147, Apr. 29, 1986, abandoned.

[30] Foreign Application Priority Data

Apr. 30, 1985 [JP] Japan ..... 60-94240

[51] Int. Cl.[4] ..... C23C 22/36

[52] U.S. Cl. ..... 148/6.2

[58] Field of Search ..... 148/6.2

[56] References Cited

U.S. PATENT DOCUMENTS 3,257,244 6/1966 Barkman ..... 148/6.2
3,382,081 5/1968 Cutter et al. ..... 148/6.2
3,708,350 1/1973 Kennedy et al. ..... 148/6.2
4,365,003 12/1982 Danforth ..... 148/6.2
4,555,445 11/1985 Frey ..... 148/6.2

*Primary Examiner*—Sam Silverberg
*Attorney, Agent, or Firm*—W. G. Fasse; D. H. Kane, Jr.

[57] ABSTRACT

A surface treatment method for improving the corrosion resistance of a ferrous sintered part, which comprises several steps. One step involves applying a liquid composition containing hexavalent chromium to the surface of the sintered part to form a adhering film of a residue from the liquid composition on the surface of the sintered part. Another step involves performing a high-temperature treatment on the sintered part in an atmosphere containing heated steam to form a dense oxide film on the surface and in the interior of the sintered part in advance of the first mentioned step utilizing the liquid composition for supplying hexavalent chromium. Additionally, or in the alternative a step of impregnating any pores in the residual film with water glass or resin is performed to seal the pores after the step of applying the liquid composition for supplying hexavalent chromium.

2 Claims, No Drawings

SURFACE TREATMENT METHOD FOR IMPROVING CORROSION RESISTANCE OF FERROUS SINTERED PARTS

This application is a continuation of Ser. No. 857,147, filed Apr. 29, 1986, now abandoned.

BACKGROUND OF THE INVENTION

1. Field of the Invention

The present invention relates to surface treatment method for improving the corrosion resistance of ferrous sintered structural parts employed as various structural parts such as those for automobiles, domestic electric devices, business machines and fishing tackle. More particularly, the invention relates to a surface treatment method comprising a step of applying a compound containing hexavalent chromium to the surfaces of the ferrous sintered parts.

2. Description of the Prior Art

The so-called ferrous sintered structural parts obtained by pressing of sintering material mainly composed of iron powder, are widely used to form, e.g., automobile parts. Such sintered structural parts can be obtained at a low cost with a high accuracy, and in case where a rust preventing ability is required, the sintered parts are subjected to a surface treatment similarly to ingot members.

For example, an extremely simple surface treatment process is plating performed on general ingot members. However, the sintered parts have residual pores, and hence the plating process cannot be performed directly on the surfaces of sintered parts. Namely, the parts must be impregnated by resin prior to plating, to seal the residual pores, in order to properly perform the plating process. Thus, the cost for the surface treatment is increased, and the surfaces of the sintered parts are partially formed by resin, whereby plated layers thus formed are easily removed, due to an insufficient adhesion strength.

Further performed is the so-called steam treatment which is a high-temperature treatment (under 400° to 600° C.) on ferrous sintered bodies in an atmosphere containing heated steam thereby to form dense oxide films mainly composed of $Fe_3O_4$ on the surfaces of the sintered parts. This steam treatment is performed at a low cost and the residual pores can be effectively sealed, however this method is not so superior for rust prevention.

Any of the conventional surface treatment methods for sintered parts as hereinabove described cannot be applied in the case where the sintered parts may be in contact with salt water or subjected to salt damage.

On the other hand, general ferrous ingots have no residual pore and hence no serious problem is caused by surface treatment, and the ferrous ingots are subjected to various rust prevention treatment processes. In general, the ferrous ingots are subjected to electric plating utilizing, e.g., zinc, and such electric plating causes environmental pollution.

In place of the electric plating process, U.S. Pat. Nos. 3,708,350 and 3,718,509 disclose methods of applying liquid mediums containing a substance for supplying hexavalent chromium to the surfaces of metal parts to be treated and heating the same for forming corrosion-resistant coating layers on the same surfaces. The coating layers are considered to have such structure that the originally contained hexavalent chromium is reduced to trivalent chromium so that polymers of the trivalent chromium cover the surfaces of, e.g., metal particles of zinc. The surface treatment method employing hexavalent chromium is far superior for rust prevention to the conventional zinc plating method. Further, this surface treatment method is excellent in that it requires no washing step and hence no environmental pollution is caused.

In the aforementioned surface treatment method employing hexavalent chromium experimentally carried out on a ferrous sintered part, however, the coating layer formed as the result rusted in several ten hours due to a salt spray test, and the sintered part was of no practical use. It is believed that this rusting is due to the fact that the ferrous sintered part included continuous and independent residual pores as hereinabove described, and hence air in the sintered metal was expanded by the heat treatment performed after application of a treating solution containing hexavalent chromium to expand the pores in the coating layer formed on the surface, whereby a large number of continuous pores were able to communicate with the surface of the sintered body and the exterior thereof.

SUMMARY OF THE INVENTION

Accordingly, it is an object of the present invention to provide a surface treatment method for improving the corrosion resistance of a ferrous sintered part.

The inventor has conducted experiments of applying various surface treatment processes to ferrous sintered parts, to find that the corrosion resistance of the sintered parts can be extremely improved by performing, in advance to (a) a step of surface treatment employing a liquid compound for supplying hexavalent chromium, (b) a step of steam treatment by treating the sintered part in an atmosphere containing heated steam, or performing (c) a step of impregnating the sintered part with water glass or resin after the step (a).

Thus, the present invention comprises the aforementioned steps (a) and (b) and/or (c).

DESCRIPTION OF THE PREFERRED EMBODIMENTS

The main part of the surface treatment method for a ferrous sintered part according to the present invention is the aforementioned step (a), i.e., the surface treatment step utilizing the liquid medium containing a substance for supplying hexavalent chromium. This step (a) utilizes a treating solution prepared by dispersing a mixture of at least one of zinc and aluminum, a hexavalent chromium providing substance such as chromic acid, a reducing agent for the hexavalent chromium providing substance and a surface active agent in a liquid medium. With respect to definite examples of the hexavalent chromium providing substance, the reducing agent and the surface active agent and an example and the mixing ratio of the liquid medium, the contents disclosed in the aforementioned U.S. Pat. Nos. 3,708,350 and 3,718,509 are incorporated with this specification.

In application of the treating solution prepared by dispersing the aforementioned mixture in the liquid medium, the ferrous sintered part may be dipped in the treating solution or the treating solution may be sprayed on the surface of the ferrous sintered part.

The surface of the sintered part to which the treating solution is applied is then heated at a temperature of 250° to 400° C., thereby to remove volatile components from the treating solution. Thus, a rust preventing film is formed on the sintered part or rather on its surface. In the rust preventing film particles of zinc and/or aluminum are surrounded by polymers of chromium oxide. This heating process can be performed by that disclosed in the aforementioned U.S. Pat. Nos. 3,708,350 or 3,718,509.

The step (b) performed in advance to the step (a) is called as steam treatment. In this step, the ferrous sintered part is treated in an atmosphere containing heated steam at a temperature of about 400° to 600° C. for several hours, thereby to form a dense oxide film mainly composed of $Fe_3O_4$ on its surface. The oxide film thus formed seals the surface of the ferrous sintered part so that pores formed in the surface film due to an expansion of air in the sintered part, are prevented from communicating with the exterior and the interior of the sintered part even if the heating process in the step (a) is performed at a temperature reaching 400° C., whereby a dense coating layer is formed. In case where the step (a) is directly performed without the step (b), a large number of pores are formed in the surface coating layer. In this case, however, the step (c) may further be performed to impregnate at least the surface of the ferrous sintered part with water glass or resin to form a film on the surface of the ferrous sintered part in the step (c), thereby to seal the pores communicating with the surface of the ferrous sintered part and the exterior. Thus, the effect of the coating layer formed in the step (a) can be retained by step (c). Examples of resins employed in the step (c) are acrylic resin, polyster, etc. The step (c) is performed by the technique well known to the art. For example, the sintered bodies are contained in a vessel to be evacuated to about 5 mm Hg and dipped in molten resin, and then the vessel is pressurized to 5~7 $Kg/cm^2$ and the parts are dipped in hot water (about 90° C.) for 15 minutes to cure them and then dried.

Preferably all of the aforementioned steps are carried out in order of steps (b), (a) and (c), thereby to extremely improve the rust preventing ability of the surface of the sintered part. Thus, it is preferable to carry out all of the steps (b), (a) and (c) particularly for those exposed to a corrosive environment. However, the respective steps may be properly combined with due regard to the usage of the sintered parts to be treated, thereby to save costs.

EXAMPLE 1

Mixed powder of 2 percent by weight of Ni, 0.5 percent by weight of C and a residue of Fe was subjected to pressure forming to obtain compacts having a density of 6.8 g/cm. The compacts were sintered in an atmosphere of an endo-thermic gas at a temperature of 1130° C. for one hour, to obtain sintered bodies of Fe—Ni—C. The following four surface treatment processes (1) to (4) were applied to the sintered bodies, which were then subjected to a rust prevention test under JIS Z 2371 (Japanese Industrial Standards). Table 1 shows the results.

(1) Performing only the following treatment:

Dipping the sintered compact in a treating solution prepared by dispersing a mixture of 55 percent by volume of chromic acid, 40 percent by volume of zinc powder and 5 percent by volume of a surface active agent in a liquid medium and removing residual drops to heat the same in a heating furnace using a heated air flow at 300° C.;

(2) Performing a resin impregnation after the process (1);

(3) Performing the process (1) after heating the sintered compact in a steam/hydrogen atmosphere of 550° C.; and (4) Performing the process (2) after performing the process (3).

Therefore, the process (1) corresponds to the step (a), the process (2) corresponds to the steps (a)+(c), the process (3) corresponds to the steps (b)+(a) and the process (4) corresponds to the steps (b)+(a)+(c).

As reference examples, conventional surface treatment methods of steam treatment and resin impregnation were applied to the same sintered bofies of Fe—Ni—C, which were then subjected to the same rust prevention test. Table 1 also shows the results.

TABLE 1

| Sample (process) | After 10 h. | After 100 h. | After 200 h. |
|---|---|---|---|
| (1) | partially rusted | entirely rusted | entirely rusted |
| (2) | not rusted | not rusted | partially rusted |
| (3) | not rusted | not rusted | not rusted |
| (4) | not rusted | not rusted | not rusted |
| Steam Treatment | entirely rusted | entirely rusted | entirely rusted |
| Resin Impregnation | entirely rusted | entirely rusted | entirely rusted |

EXAMPLE 2

Powder mainly composed of Fe powder was pressure-formed through use of a metal mold to be 6.9 $g/cm^3$ in density and sintered in an atmosphere of endo thermic gas at 1130° C. for one hour to obtain a size-corrected ferrous sintered part (hereinafter referred to as "sized part"). The process (4) of Example 1 was carried out in order of the steps (b), (a) and (c) on the sizing, which was then subjected to a rust prevention test (JIS Z 2371), to attain an excellent effect since no rust appeared after a lapse of 550 hours.

Such sizing process is generally performed in order to improve size accuracy of sintered parts, whereas work strain remains after the said process. Sized parts are again heated through a magnetic annealing step in case where magnetic characteristics are required, while the sized part of Example 2 was heated at 550° C. (the process (3) of Example 1) in order to improve the rust preventing ability, whereby the same was simultaneously improved in its magnetic characteristic without the magnetic annealing step, as shown in Table 2.

TABLE 2

| | Magnetic Flux Density (KG) |
|---|---|
| Sintered Part | 8.5 |
| Sized Part | 6.4 |
| Surface-Treated Part | 8.3 |

Although the present invention has been described in detail, it is clearly understood that the same is by way of illustration and example only and is not to be taken by way of limitation, the spirit and scope of the present invention being limited only by the terms of the appended claims.

What is claimed is:

1. A method for treating the surface of a ferrous sintered part having pores therein, consisting of the steps of treating said sintered part in a steam atmosphere heated to a temperature within the range of about 400° to 600° C. for several hours duration sufficient to form a dense film of iron oxide on the surface and in the interior of said sintered part, said dense iron oxide film sealing said pores in the surface layer of said sintered part; preparing a treating solution by dispersing in a liquid a mixture of at least one of zinc and aluminum, a hexavalent chromium providing substance, a reducing agent for said hexavalent chromium providing substance, and a surface active agent, applying said treating solution to the surface of said dense iron oxide film of said steam treated sintered part, heating said sintered part with the treating solution applied to said iron oxide film, at a temperature of 250° to 400° C. to remove volatile components from said treating solution to thereby form a coating film of particles of zinc and/or aluminum surrounded by polymers of trivalent chromium on said dense iron oxide film of said sintered parts, and impregnating at least said coating film by applying water glass or resin to said coating film for sealing said coating film.

2. The method of claim 1, wherein said treating solution is applied by dipping said steam treated sintered part into said treating solution.

* * * * *